US007044101B1

(12) United States Patent
Duty et al.

(10) Patent No.: US 7,044,101 B1
(45) Date of Patent: May 16, 2006

(54) METHOD AND CODE FOR CONTROLLING REACTIVATION OF DEACTIVATABLE CYLINDER USING TORQUE ERROR INTEGRATION

(75) Inventors: Mark J Duty, Goodrich, MI (US); Michael A Bonne, Leonard, MI (US); Michael J Prucka, Grass Lake, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 11/064,571

(22) Filed: Feb. 24, 2005

(51) Int. Cl.
*F02B 77/00* (2006.01)

(52) U.S. Cl. ..... 123/198 F

(58) Field of Classification Search ..... 123/198 F
See application file for complete search history.

(56) References Cited

U.S. PATENT DOCUMENTS

| | | | |
|---|---|---|---|
| 4,585,101 | A | 4/1986 | Danno |
| 5,374,224 | A | 12/1994 | Huffmaster et al. |
| 5,408,974 | A | 4/1995 | Lipinski et al. |
| 5,568,795 | A | 10/1996 | Robichaux et al. |
| 5,611,754 | A | 3/1997 | Haga et al. |
| 6,311,670 | B1 | 11/2001 | Constancis |
| 6,843,752 | B1 | 1/2005 | Bolander |
| 2004/0244744 | A1 | 12/2004 | Falkowski et al. |
| 2004/0244761 | A1 | 12/2004 | Falkowski et al. |

OTHER PUBLICATIONS

Bates, B.; Dosdall, J.M.; and Smith, D.H.; "Variable Displacement by Engine Valve Control," SAE Paper No. 780145 (New York, NY; 1978).

Mueller, Robert S.; and Uitvlugt, Martin W.; "Valve Selector Hardware," SAE Publication No. 780146 (New York, NY; 1978).

Fukui, Toyoaki; Nakagami, Tatsuro; Endo, Hiroyasu; Katsumoto, Takehiko; and Danno. Yoshiaki; "Mitsubishi Orion-MD—A New Variable Displacement Engine," SAE Paper No. 831007 (New York, NY; 1983).

(Continued)

*Primary Examiner*—Noah P. Kamen
(74) *Attorney, Agent, or Firm*—Ralp E. Smith

(57) ABSTRACT

In an internal combustion engine adapted to operate in a cylinder-deactivation mode, a method for controlling the reactivation of a deactivated cylinder includes determining a difference between a torque request from a vehicle operator, and an estimate of a maximum engine torque achievable in cylinder-deactivation mode based at least in part on a current engine speed. The difference is integrated over time to obtain a torque request "error." A reactivation of the deactivated cylinder is triggered when the torque request error exceeds a first threshold value, which can be a calibrated value, a calibrated value adapted, for example, for driving style, or a value determined from a vehicle operating parameter such as vehicle speed. The use of the torque request error advantageously avoids reactivation of the deactivated cylinders in response to brief transients in the torque request signal that otherwise temporarily exceed the maximum achievable engine output torque.

14 Claims, 2 Drawing Sheets

OTHER PUBLICATIONS

Hatano, Kiyoshi; Iida, Kazumasa; Higashi, Hirohumi; and Murata, Shinichi; "Development of a New Multi-Mode Variable Valve Timing Engine," SAE Paper No. 930878 (New York, NY; 1993).

McElwee, Mark; and Wakeman, Russell; "A Mechanical Valve System with Variable Lift, Duration, and Phase Using a Moving Pivot," SAE Paper No. 970334 (New York, NY; 1997).

Yacoub, Yasser; and Atkinson, Chris; "Modularity in Spark Ignition Engines: A Review of its Benefits, Implementation and Limitations," SAE Publication No. 982688 (New York, NY; 1998).

Zheng, Quan; "Characterization of the Dynamic Response of a Cylinder Deactivation Valvetrain System," SAE Publication No. 2001-01-0689 (New York, NY; 2001).

Leone, T.G.; and Pozar, M.; "Fuel Economy Benefit of Cylinder Deactivation—Sensitivity to Vehicle Application and Operating Constraints, " SAE Paper No. 2001-01-3591 (New York, NY; 2001).

Patton, Kenneth J.; Sullivan, Aaron M.; Rask, Rodney B.; and Theobald, Mark A.; "Aggregating Technologies for Reduced Fuel Consumption: A Review of the Technical Content in the 2002 National Research Council Report on CAFE," SAE Paper No. 2002-01-0628 (New York, NY; 2002).

Falkowski, Alan G.; McElwee, Mark R.; and Bonne, Michael A.; "Design and Development of the Daimlerchrysler 5.71 Hemi Engine Multi -Displacement Cylinder Deactivation System," SAE Publication No. 2004-01-2106 (New York, NY, May 7, 2004).

METHOD AND CODE FOR CONTROLLING REACTIVATION OF DEACTIVATABLE CYLINDER USING TORQUE ERROR INTEGRATION

FIELD OF THE INVENTION

The invention relates generally to methods and computer-executable code for controlling the operation of an internal combustion engine for a motor vehicle that features deactivatable cylinders.

BACKGROUND OF THE INVENTION

The prior art teaches equipping vehicles with "variable displacement," "displacement on demand," or "multiple displacement" internal combustion engines in which one or more cylinders may be selectively "deactivated," for example, to improve vehicle fuel economy when operating under relatively low-load conditions. Typically, the cylinders are deactivated through use of deactivatable valve train components, such as the deactivating valve lifters as disclosed in U.S. patent publication no. US 2004/0244751 A1, whereby the intake and exhaust valves of each deactivated cylinder remain in their closed positions notwithstanding continued rotation of their driving cams. Combustion gases are thus trapped within each deactivated cylinder, whereupon the deactivated cylinders operate as "air springs" to reduce engine pumping losses.

When vehicle operating conditions are thereafter deemed to require an engine output torque greater than that achievable without the contribution of the deactivated cylinders, as through a heightened torque request from the vehicle operator based upon a detected intake manifold air pressure representing a current engine load, the deactivatable valve train components are returned to their nominal activated state to thereby "reactivate" the deactivated cylinders. More specifically, under one prior art approach, a torque request or torque demand signal, as determined, for example, from current accelerator pedal position and current engine speed, is compared to a mapped value for available engine torque at that engine speed. A value for a torque "reserve" representing an output torque "cushion" during a subsequent transition to a full-cylinder-activitation mode with no more than a negligible torque disturbance (generally imperceptible to the vehicle operator) is also calculated or provided. When the torque request exceeds the mapped threshold value less the reserve threshold, the engine control module initiates a "slow" transition out of the cylinder-deactivation engine operating mode. These "slow" transitions, intended to feature only those transition torque disturbances that are generally imperceptible to the vehicle operator, are to be distinguished from "fast" transitions that are typically triggered in response, for example, a torque request that well exceeds the available engine torque, under which conditions a noticeable torque disturbance is perhaps even desirable as feedback to the vehicle operator.

Unfortunately, such an approach to "slow" transitions from a cylinder-deactivation mode to a full-cylinder-activation mode is likely to initiate a transition in response, for example, to a minor torque request excursion above the mapped threshold value not otherwise requiring the greater torque potential of full-cylinder engine operation, thereby significantly reducing the fuel economy advantage that might otherwise be achieved through use of the cylinder-deactivation engine operating mode.

BRIEF SUMMARY OF THE INVENTION

In accordance with an aspect of the invention, a method for controlling a "slow" reactivation of a given deactivated cylinder of a multi-displacement internal combustion engine includes determining, while operating the engine in a partial-displacement mode characterized by deactivation of the given cylinder, a torque request based at least in part on a driver demand signal, as may be conveniently determined and stored by an engine control module or powertrain controller when determining other engine operating parameters, such as target mass air flow and fuel flow rates. The method also includes estimating a maximum potential output torque for the engine in the cylinder-deactivation mode based at least in part on a first engine operating parameter, for example, by retrieving mapped values from a lookup table based on a current engine speed. The method further includes calculating a difference by which the torque request exceeds the maximum potential output torque; integrating the calculated differences over time to obtain a torque request error measure; and initiating a switch from the partial-displacement mode to a full-displacement mode (characterized by activation of the deactivatable cylinder) when the torque request error measure is not less than a first threshold value.

In accordance with another aspect of the invention, when estimating the maximum potential output torque, the method preferably further includes offsetting the first value by a second value representing a torque offset correlated with a noise-vibration-harshness (NVH) threshold for a slow transition at a given engine speed, for example, by retrieving the second value from a second lookup table containing calibratable values for torque offset, mapped as a function of both engine speed and current vehicle speed (the latter similarly having an impact on the desired evaluation of the torque request, and the avoidance of more than a negligible torque disturbance during any slow transition).

In accordance with yet another aspect of the invention, the first threshold value, to which the torque request error measure is compared, is either a calibratable value; a calibratable value adapted, for example, based on such information as an indication of a vehicle operator driving style; or a value retrieved from a lookup table based, for example, on one of a determined indication of vehicle operator driving style and an operator-selectable indication of a desired vehicle fuel economy.

From the foregoing, it will be appreciated that brief, minor torque request excursions above the current maximum potential engine torque output, when operating the engine in a cylinder-deactivated mode, will not generally not trigger a reactivation of the deactivated cylinders, because a "slow" switch to a full-cylinder-activation mode based upon an increased torque request is initiated only when the integrated torque request "error" exceeds a predetermined threshold value.

Other objects, features, and advantages of the present invention will be readily appreciated upon a review of the subsequent description of the preferred embodiment and the appended claims, taken in conjunction with the accompanying Drawings.

DETAILED DESCRIPTION OF THE INVENTION

Figure 1:
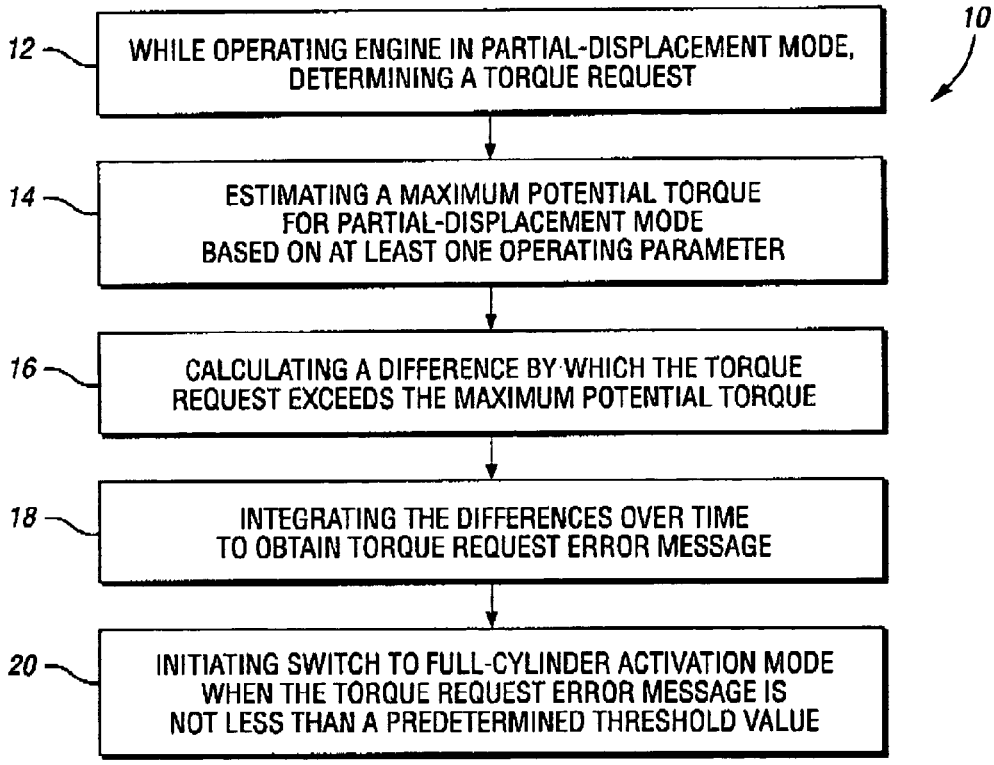
FIG. 1 is a flow chart illustrating the main steps of a method in accordance with an aspect of the invention for controlling a reactivation of a deactivated cylinder of a multi-displacement internal combustion engine in response to torque requests.

A method 10 for controlling a reactivation of a given deactivated cylinder of a multi-displacement internal combustion engine is generally illustrated in FIG. 1. While the invention contemplates any suitable hydraulic and/or electromechanical systems for deactivating the given cylinder, including deactivatable valve train components, a constructed embodiment features an eight-cylinder engine in which four cylinders are selectively deactivated through use of deactivatable valve lifters as disclosed in U.S. patent publication no. US 2004/0244751 A1, the teachings of which are hereby incorporated by reference.

As seen in FIG. 1, the method 10 generally includes determining, at block 12, a torque request while the engine is operating in a partial-displacement or cylinder-deactivation mode. Typically, the torque request is determined by an engine or powertrain controller based, for example, upon a detected position of the vehicle's accelerator pedal and a current engine speed, as through the use of a lookup table, preferably as further modified by at least one other engine or vehicle operating parameter, for example, detected or determined values representing instantaneous accessory loads, ambient barometric pressure, ambient temperature, oil or engine temperature, instantaneous oil viscosity.

Returning to FIG. 1, at block 14, the method 10 further includes estimating a potential output torque for the engine in the partial displacement mode based on at least one engine operating parameter. While the invention contemplates estimating the maximum potential output torque on any one or more suitable engine operating parameters, in the exemplary computer-executable process 22 described below in connection with FIG. 2, the maximum potential output torque is estimated as a function of current engine speed and manifold air pressure, as by retrieving values for maximum potential output torque from a first lookup table containing maximum engine output torque values as a function of engine speed.

At block 16 of FIG. 1, the method 10 includes calculating a difference by which the torque request exceeds the maximum potential output torque at the current engine speed; and, at block 18, integrating the differences over time using a suitable time interval to obtain a torque request "error" measure. Finally, at block 20, the method 10 includes initiating a switch to a full-cylinder activation mode when the torque request error measure is not less than a predetermined threshold value. The threshold value is a calibratable value, perhaps as retrieved from a lookup table containing several calibrated values, selected as a function of an indicated vehicle operator driving style. In this manner, a given vehicle operator's apparent willingness to accept more "abrupt" transitions between engine operating modes can be reflected in a higher selected threshold value, with the further benefit of enabling longer engine operation in the partial-displacement mode for enhanced vehicle fuel economy.

Figure 2:
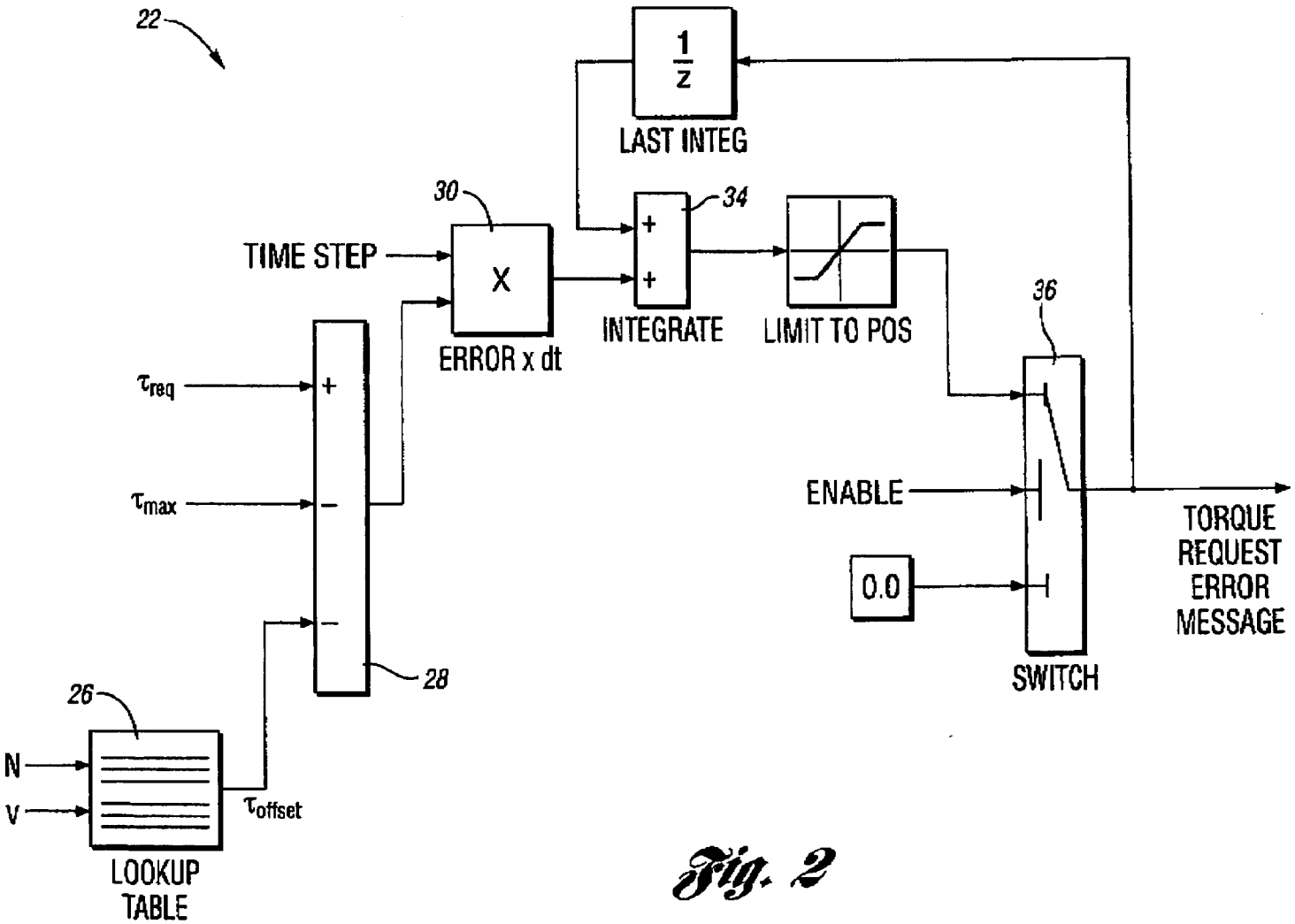
FIG. 2 shows an exemplary computer-executable process for controlling a reactivation of a deactivated cylinder in response to determined values for a torque request, in accordance with the invention.

Referring to FIG. 2, an exemplary computer-executable process 22, suitable for storage in a computer-readable storage medium (not shown), for generating the torque request error measure includes retrieving a torque request $T_{req}$, for example, as stored in a powertrain controller (not shown). While the invention contemplates any suitable determination by the powertrain controller of the torque request value $T_{req}$, by way of example only, the torque request value $T_{req}$ is conveniently determined based on a current accelerator pedal position (as a driver demand signal), a current engine speed, and such other additional inputs as are known to one of ordinary skill in the art to be useful in determining an instantaneous torque request, such as engine accessory loads and barometric pressure.

As seen in FIG. 2, the exemplary process 22 includes retrieving a predeteremined an instantaneous value $T_{max}$ value representing a current estimate of the engine's maximum potential output torque at the current engine speed N, as calculated by a powertrain controller (not shown) using any suitable torque model process, for example, based on engine speed, manifold pressure and barometric pressure, coolant temperature, and accessory loads. As seen in FIG. 2, the exemplary process 22 further retrieves, from a second lookup table 26 containing calibratable values representing an offset value $T_{offset}$ representing a torque offset correlated with an NVH threshold for a slow transition from the partial-displacement mode to the full-displacement mode at a given engine speed N and vehicle speed v.

Significantly, under an aspect of the invention, the torque offset value $T_{offset}$ can have either a positive or a negative sign, depending upon the level of NVH that may be permitted for a given vehicle/engine combination at the table's designated ranges of engine speed and vehicle speed. For example, because a vehicle operator is more likely to be sensitive to torque fluctuations and/or NVH increases at relatively low engine or vehicle speeds, the torque offset value $T_{offset}$ is nominally greater at such relatively low engine or vehicle speeds; however, for example, because of the higher levels of ambient noise associated with relatively higher engine and vehicle speeds, the torque offset value $T_{offset}$ vehicle generally becomes numerically less—or even has a negative sign—at such relatively higher engine and vehicle speeds. By way of further example only, FIG. 3 contains a plot, for a given vehicle speed, of both the nominal maximum potential output torque $T_{max\text{-}nominal}$ as a function of engine speed, and of an offset maximum output torque $T_{max\text{-}offset}$ effectively illustrating the combination of the nominal maximum potential output torque $T_{max\text{-}nominal}$ and the torque offset $T_{offset}$ with which the requested torque is to be substantively compared.

At block 28, the retrieved torque request $T_{req}$, maximum potential output torque value $T_{max}$, and torque offset value $T_{offset}$ are summed to thereby calculate a difference or "error," which is then scalar-calibrated based on a selected loop time in multiplier block 30 using a calibrated time step. The resulting torque-time product is integrated at block 34, and positive values for the resulting torque request error measure are supplied to a switch 36 under the control of a suitable flag, ENABLE, for subsequent comparision to the predetermined threshold.

Referring again to FIG. 3, it will be seen that, when operating in a partial-displacement mode at a given engine speed $N_1$, an instantaneous torque request value $T_{req1}$ greater than the offset maximum output torque $T_{max\text{-}offset}$ will generate a positive error at summation block 28 of FIG. 2, while an instantaneous torque request value $T_{req2}$ less than the offset maximum output torque $T_{max\text{-}offset}$ will generate a negative error at summation block 28 of FIG. 2. In this manner, brief torque request excursions above the offset maximum output torque $T_{max\text{-}offset}$ will be effectively countered by relatively contemporaneous torque requests that are below the offset maximum output torque $T_{max\text{-}offset}$. In this manner, the exemplary process 22 advantageously avoids a discontinuance of partial-displacement operation in response to such brief torque request excursions above the offset maximum output torque $T_{max\text{-}offset}$.

Figure 3:
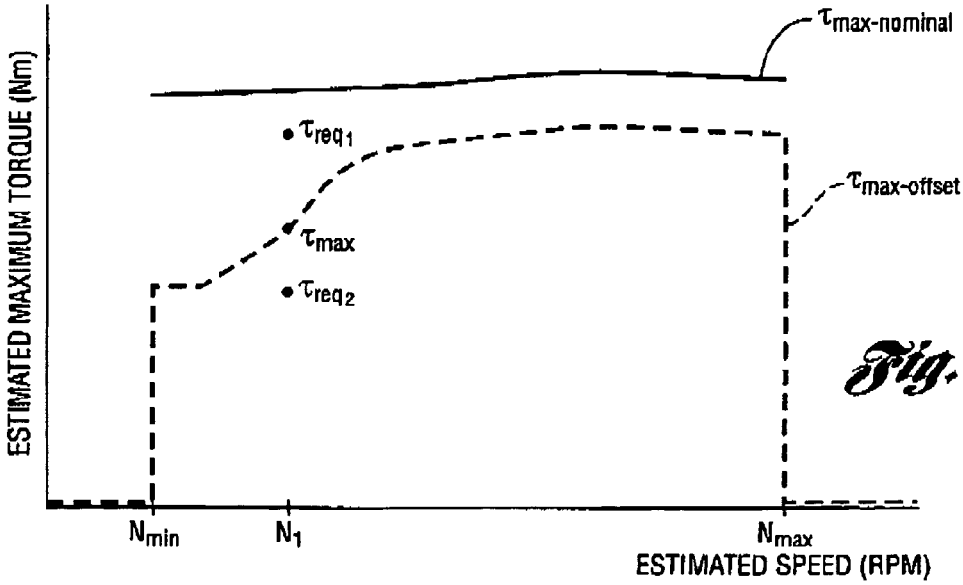
FIG. 3 is a plot of estimated maximum flow chart illustrating in detail an exemplary method under the invention.

FIG. 3 further shows the range of engine speeds, from a minimum engine speed $N_1$ to a maximum engine speed $N_2$, within which to enable a slow reactivation of the deactivated cylinders based upon the determined torque request error measure.

While the above description constitutes the preferred embodiment, it will be appreciated that the invention is susceptible to modification, variation and change without departing from the proper scope and fair meaning of the subjoined claims.

What is claimed is:

1. A method for controlling a reactivation of a given deactivated cylinder of a multi-displacement internal combustion engine, the method comprising:

determining, while operating the engine in a partial-displacement mode characterized by deactivation of the given cylinder, a torque request based at least in part on a driver demand signal;

estimating a maximum potential output torque for the engine when operating in a partial-displacement mode based at least in part on a first engine operating parameter;

calculating a difference by which the torque request exceeds the maximum potential output torque;

integrating the calculated differences over time to obtain a torque request error measure; and initiating a switch from the partial-displacement mode to a full-displacement mode characterized by activation of the deactivatable cylinder when the torque request error measure is not less than a first threshold value.

2. The method of claim 1, wherein the first engine operating parameter is a current engine speed, and wherein estimating the maximum potential output torque includes retrieving a first value from a first lookup table containing a first plurality of maximum engine output torque values based on the current engine speed.

3. The method of claim 2, wherein estimating the maximum potential output torque includes:

retrieving a second value from a second lookup table containing a second plurality of torque offset values based at least in part on the current engine speed, the torque offset values being representative of an NVH threshold for transitioning with no more than a negligible torque disturbance; and summing the first value and the second value to obtain the maximum potential output torque.

4. The method of claim 3, including retrieving the second value from the second lookup table based on a current vehicle speed.

5. The method of claim 1, wherein the first threshold value is a calibratable value adapted based on an indication of a vehicle operator driving style.

6. The method of claim 1, wherein the first threshold is determined based on a vehicle operating parameter.

7. The method of claim 6, wherein the vehicle operating parameter is an indication of vehicle operator driving style.

8. The method of claim 6, wherein the vehicle operating parameter is an operator-selectable indication of a desired vehicle fuel economy.

9. A computer-readable storage medium including computer executable code for controlling a reactivation of a given deactivated cylinder of a multi-displacement internal combustion engine, the storage medium including:

code for determining, while the engine is operating in a partial-displacement mode, a torque request based at least in part on a driver demand signal;

code for estimating a maximum potential output torque for the engine in the cylinder-deactivation mode based at least in part on a first engine operating parameter;

code for calculating a difference by which the torque request exceeds the maximum potential output torque;

code for integrating the calculated differences over time to obtain a torque request error measure; and code for initiating a switch from the partial-displacement mode to a full-displacement mode characterized by activation of the deactivatable cylinder when the torque request error measure is not less than a first threshold value.

10. The method of claim 9, wherein the code for estimating the maximum potential output torque includes code for retrieving a first value from a first lookup table containing a first plurality of maximum engine output torque values based on a current engine speed.

11. The storage medium of claim 10, wherein the code for estimating the maximum potential output torque further includes:

code for retrieving a second value from a second lookup table containing a second plurality of torque offset values based at least in part on the current engine speed, the torque offset values being representative of an NVH threshold for transitioning with no more than a negligible torque disturbance; and code for summing the first value and the second value to obtain the maximum potential output torque.

12. The storage medium of claim 11, including retrieving the second value from the second lookup table based on a current vehicle speed.

13. The storage medium of claim 9, including code for adapting the first threshold value based on an indication of a vehicle operator driving style.

14. The storage medium of claim 9, including code for determining the first threshold based on one of a determined indication of vehicle operator driving style and an operator-selectable indication of a desired vehicle fuel economy.

* * * * *